US006769425B1

(12) United States Patent
Kim

(10) Patent No.: US 6,769,425 B1
(45) Date of Patent: Aug. 3, 2004

(54) FUEL-FIRED FURNACE WITH COMBUSTION AIR-COOLED DRAFT INDUCER FAN MOTOR

(75) Inventor: Seung-Ho Kim, Fort Smith, AR (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/694,308

(22) Filed: Oct. 27, 2003

(51) Int. Cl.[7] ..... F24H 3/02

(52) U.S. Cl. ..... 126/110 R; 126/99 R; 126/110 A; 432/77; 432/145; 432/233

(58) Field of Search ..... 126/110 R, 110 C, 126/99 R, 85 B, 104 A, 112, 116 R, 99 D, 312, 110 A; 432/233, 77, 173; 310/52, 53, 58, 63; 165/47, 48.1; 110/162; 417/368, 423.8

(56) References Cited

U.S. PATENT DOCUMENTS

| | | | | |
|---|---|---|---|---|
| 3,010,449 A | | 11/1961 | Owen | 126/110 |
| 4,309,165 A | | 1/1982 | McElroy | 431/8 |
| 4,556,386 A | | 12/1985 | McElroy | 432/149 |
| 4,651,711 A | * | 3/1987 | Velie | 126/110 C |
| 4,848,313 A | | 7/1989 | Velie | 126/110 C |
| 5,375,651 A | | 12/1994 | Colwell | 165/47 |
| 6,138,666 A | | 10/2000 | Hubbard | 126/307 R |
| 6,296,478 B1 | | 10/2001 | Gatley, Jr. | 432/77 |
| 6,318,358 B1 | * | 11/2001 | Gatley, Jr. | 126/110 R |
| 6,341,949 B1 | | 1/2002 | Garloch | 417/363 |
| 6,352,431 B1 | | 3/2002 | Gatley, Jr. | 432/77 |
| 6,382,203 B1 | * | 5/2002 | Kim et al. | 126/110 R |

OTHER PUBLICATIONS

"90 Plus Hi–Efficiency Gas Furnace Service Manual" Cover and pp. 1–6, Rheem Manufacturing Company (1994).
Unpublished Explanatory Drawing—90 Plus Furnace (Oct. 1, 2003).

* cited by examiner

*Primary Examiner*—James C. Yeung
(74) *Attorney, Agent, or Firm*—Konneker & Smith, P.C.

(57) ABSTRACT

A fuel-fired, forced draft air heating furnace has a draft inducer fan disposed in a vestibule chamber having an exterior wall with an air intake opening therein. During operation of the draft inducer fan its motor is cooled by combustion air drawn inwardly through the air intake opening. To enhance the combustion air cooling of the draft inducer fan motor, a deflection plate is supported within the vestibule chamber in an inwardly spaced apart, facing relationship with the air intake opening. A portion of the combustion air flowing inwardly through the air intake opening impinges on and is redirected by the plate toward the motor via a substantially unenclosed flow path within the vestibule chamber.

22 Claims, 2 Drawing Sheets

FUEL-FIRED FURNACE WITH COMBUSTION AIR-COOLED DRAFT INDUCER FAN MOTOR

BACKGROUND OF THE INVENTION

The present invention generally relates to fuel-fired heating appliances and, in a preferred embodiment thereof, more particularly relates to a forced draft, fuel-fired furnace having incorporated therein specially designed apparatus for utilizing combustion air to cool its draft inducer fan motor.

Various types and sizes of fuel-fired heating appliances are provided with draft inducer fans which are communicated with the interior of the heat exchange portion of the appliance and serve to forcibly expel combustion gases therefrom and deliver the expelled combustion gases to a vent stack structure operatively coupled to the appliance. For example, in conventional forced draft, fuel-fired air heating furnaces the draft inducer fan is often located within a burner vestibule area of the furnace, with a negative pressure created in the vestibule area by the draft inducer fan being utilized to draw combustion air into the vestibule, via louvers or other openings in an exterior wall portion of the vestibule, for delivery to the burners in the vestibule. Combustion air entering the vestibule flows freely through the substantially open interior of the vestibule to the burners.

Because the draft inducer fan is located in the enclosed furnace vestibule area of the furnace, the inducer fan motor can often be subjected to undesirably high operating temperatures. One previously proposed solution to this potential inducer fan motor overheating problem is illustrated and described in U.S. Pat. No. 6,382,203 to Kim et al and comprises the provision of an air transfer duct structure extending through the interior of the vestibule chamber and mechanically interconnected between the air intake opening and the draft inducer fan motor. Operation of the draft inducer fan cools its motor by flowing substantially all of the combustion air entering the air intake opening through the transfer duct structure and across the inducer fan motor prior to this incoming combustion air being discharged from the transfer duct structure and being delivered to the furnace burners within the vestibule chamber.

While this previously proposed combustion air-based inducer fan motor cooling technique provides for substantially enhanced cooling of the motor compared to the conventional approach of simply permitting the incoming air to migrate unchanneled through the substantially open vestibule chamber interior to the burners therein, it undesirably increases both the fabrication complexity and overall production cost of the furnace in which it is incorporated. A need thus exists for improved combustion air-based apparatus and methods for cooling the motor of a draft inducer fan disposed in a chamber portion of a furnace or other type of fuel-fired, forced draft heating appliance. It is to this need that the present invention is directed.

SUMMARY OF THE INVENTION

In carrying out principles of the present invention, in accordance with a preferred embodiment thereof, a fuel-fired, forced draft heating appliance, representatively a gas-fired air heating furnace, is provided and has a chamber having an exterior wall with an air intake opening therein, a heat exchanger, and a fuel burner representatively disposed in the chamber and operative to create hot combustion products in the heat exchanger.

A draft inducer fan is also disposed in the chamber and is operative to expel flue gas from the heat exchanger. During operation of the furnace, the draft inducer fan creates within the chamber a negative pressure that draws a first quantity of combustion air into the chamber, for delivery to the fuel burner, sequentially through the air intake opening, through the interior of the chamber via a substantially unenclosed flow path therein, and against the motor in a manner cooling it prior to delivery of the first quantity of combustion air to the fuel burner.

According to a key aspect of the present invention, this combustion air cooling of the draft inducer fan motor is enhanced by a deflector structure supported within the chamber in an inwardly spaced apart, facing relationship with the air intake opening. The deflector structure, which is representatively a flat deflector plate member supported in the chamber by an integral flat support portion, angled relative to the deflector plate, is operative to be impinged by the first quantity of combustion air after it enters the chamber and redirect such combustion air generally toward the draft inducer fan motor through the aforementioned substantially unenclosed flow path within the chamber. Representatively, operation of the draft inducer fan also draws a second quantity of combustion air, which may also impinge upon the deflector plate, inwardly through the air intake opening for delivery to the fuel burner through the interior of the chamber via a substantially unenclosed flow path therein which bypasses the draft inducer fan motor.

In a preferred embodiment of the furnace the fuel burner is representatively an inshot-type fuel burner and the furnace includes a baffle structure for shielding the burner from flicker-creating impingement by the combustion air being delivered to the burner; the draft inducer fan motor has a housing portion with a plurality of cooling openings therein via which a portion of the first combustion air quantity is drawn through the interior of the motor housing portion during operation of the draft inducer fan; and the draft inducer fan includes a fan housing, the fan motor is disposed externally of the fan housing and rotationally drives a shaft, and the draft inducer fan further includes a fan blade structure mounted on the shaft and operative to flow combustion air through the interior of the motor to enhance combustion air cooling of the motor.

While principles of the present invention are representatively illustrated and described herein as being incorporated in a fuel-fired, force draft air heating furnace, it will be readily appreciated by those of ordinary skill in this particular art that such principles could also be advantageously utilized in a variety of other types of fuel-fired, forced draft heating appliances as well, and are not limited to being applied to furnaces.

DETAILED DESCRIPTION

Figure 1:
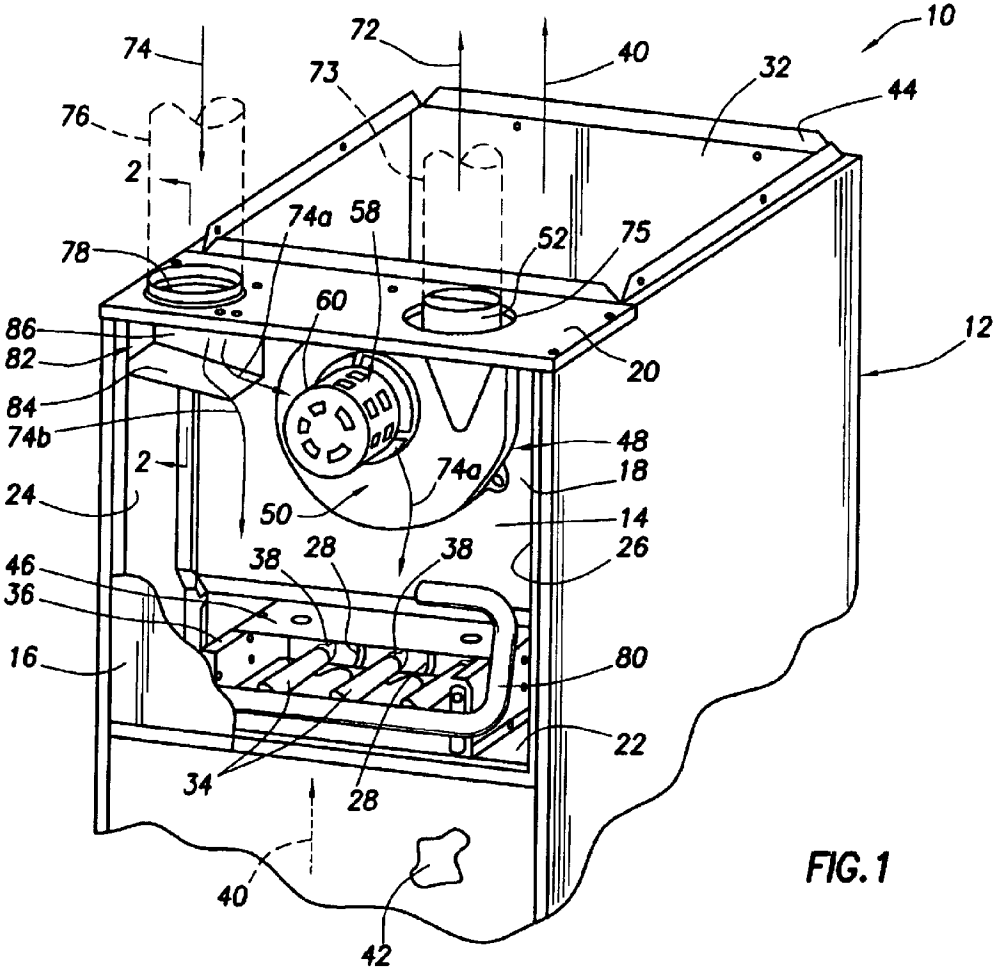
FIG. 1 is a partially cut away perspective view of an upper end portion of a representative fuel-fired, forced draft air heating furnace having a draft inducer fan with a motor which is cooled using combustion air in a manner embodying principles of the present invention.

As perspectively illustrated in FIG. 1, this invention provides a specially designed fuel-fired heating appliance which is representatively in the form of a gas-fired, forced draft air heating furnace 10 having a generally rectangular outer housing 12 with a sealed burner vestibule chamber 14 rearwardly inset into a top front portion thereof. The sealed vestibule chamber 14 serves as a combustion chamber for the furnace and has a removable front access wall 16, a rear wall 18, top and bottom walls 20 and 22, and left and right vertical side walls 24 and 26. Extending rearwardly through a bottom portion of the rear chamber wall 18 are inlet openings 28 of a fuel-fired heat exchanger structure 30 (see FIG. 3) positioned in an air heating chamber 32 extending vertically through the outer housing 12.

During firing of the furnace 10, inshot-type gas burners 34 supported in a lower portion of the vestibule chamber 14 on a frame structure 36 inject flames 38 into the heat exchanger inlet openings 28. Combustion heat within the heat exchanger 30 is transferred to supply air 40 flowed upwardly through the heating chamber 32, by a supply blower 42 mounted therein, for delivery through an upper housing end opening 44 of the heating chamber 32 to a conditioned space served by the furnace 10. A baffle plate 46 secured to the upper side of the frame structure 36 overlies outlet portions of the burners 34 and shields their flames 38 from flicker-creating impingement by combustion air flowed through the sealed vestibule chamber 14 to the burners 34 as later described herein.

Figure 3:
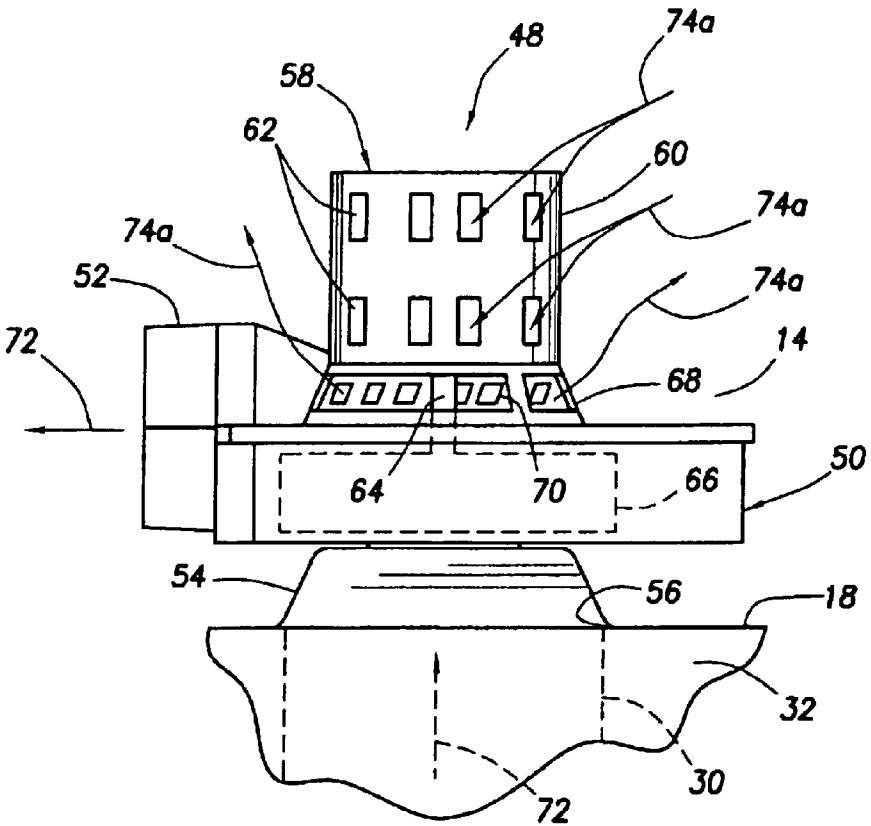
FIG. 3 is an enlarged scale side elevational view of the draft inducer fan.

Operatively mounted within an upper portion of the vestibule chamber 14 is a draft inducer fan 48 which is representatively of a conventional construction and is commercially available from the Fasco company of Cassville, Mo. The draft inducer fan 48, as best illustrated in FIG. 3, has a fan housing structure 50 with an outlet portion 52, and an inlet portion 54 coupled to the outlet of the heat exchanger 30 through an opening 56 in the rear vestibule chamber wall 18. An electric motor 58 supported on the fan housing 50 within the vestibule chamber 14 has a housing portion 60 in which a spaced series of cooling openings 62 are formed, the openings 62 communicating with the interior of the motor 58. Motor 58 has a drive shaft 64 which rotationally drives a fan impeller 66 disposed within the fan housing 50. A slotted finger guard 68 positioned between the motor housing 60 and the fan housing 50 circumscribes the shaft 64 and an auxiliary circulating fan blade structure 70 supported on the shaft 64 for driven rotation thereby.

The draft inducer fan 48, during firing of the furnace 10, serves to draw hot combustion products 72 through the interior of the heat exchanger 30 and then expel the combustion products 72 from the furnace 10 via the fan outlet 52 which is coupled to a vent stack 73 extending upwardly from a vent opening 75 in the top vestibule chamber wall 20. Heat from the combustion products 72 flowing through the interior of the heat exchanger 30 is transferred to the supply air 40 interiorly traversing the heating chamber 32 and flowing externally across the heat exchanger 30 therein.

As the draft inducer fan 48 draws the hot combustion products 72 through the heat exchanger 30 the fan 48 creates a negative pressure within the sealed vestibule chamber 14. In turn, this negative pressure draws combustion air 74 from outside the furnace 10 into the vestibule chamber 14, via an air inlet duct 76 connected to an air intake opening 78 in the top vestibule chamber wall 20, for delivery through the chamber 14 to the burners 34 for mixture and combustion with fuel being delivered thereto via a gas manifold structure 80.

Figure 2:
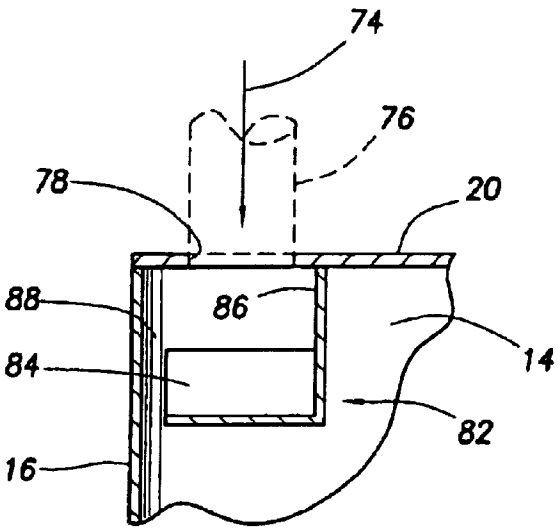
FIG. 2 is an enlarged scale simplified cross-sectional view through the furnace taken along line 2—2 of FIG. 1 and illustrating a specially designed deflector structure of the present invention.

In accordance with principles of the present invention, the combustion air 74 flowing through the interior of the sealed vestibule chamber 14 is utilized in a unique manner to cool the draft inducer fan is motor 58. As best illustrated in FIGS. 1 and 2, this combustion air cooling of the draft inducer fan motor 58 is substantially enhanced by the provision of a small deflector structure 82 which is mounted in the vestibule chamber 14 inwardly adjacent the air intake opening 78.

The deflector structure 82 is representatively of a simple sheet metal construction and comprises a generally horizontal flat deflector plate 84 from an edge portion of which an integral support plate 86 transversely extends in an upward direction. An upper edge portion of the support plate 86 is anchored to the underside of the top vestibule chamber wall 20 and is positioned thereon so that the support plate 86 mounts the deflector plate 84 within the vestibule chamber 14 in an inwardly spaced apart, generally facing relationship with the air intake opening 78. As illustrated, the deflector plate 84 is spaced generally horizontally apart from the draft inducer fan motor 58 and is representatively tilted downwardly toward the motor 58 so that the plane of the flat top side of the deflector plate 84 passes through the motor 58. Representatively, a gap 88 is present between the front edge of the deflector plate 84 and the front vestibule chamber access wall 16 (see FIG. 2).

Upon entering the vestibule chamber 14 through the air intake opening 78, the combustion air 74 impinges on the top side of the sloping deflector plate 84 which redirects a major portion of the combustion air 74 generally toward the draft inducer fan motor 58, with the gap 88 permitting a smaller portion of the combustion air 74 to flow downwardly past the deflector plate 84. A first quantity 74*a* of the plate-impinging combustion air 74 is re-directed by the plate 84 generally toward the draft inducer fan motor 58, through a substantially unenclosed flow path within the vestibule chamber 14, and impinges on the motor 58. At least a portion of this first combustion air quantity 74*a* is drawn through the interior of the motor housing 60, via its cooling openings 62, by operation of the circulating fan blade structure portion 70 of the motor 58, to cool the motor 58. The portion of the first combustion air quantity 74*a* interiorly traversing the motor housing 60 exits the slotted finger guard structure 68, and flows with the balance of the combustion air quantity 74*a* to the burners 34 via a substantially unenclosed flow path within the interior of the sealed vestibule chamber 14.

A second quantity 74*b* of the incoming combustion air 74, which may include combustion air flowing downwardly through the gap 88, bypasses the draft inducer fan motor 58 and flows directly to the burners 34 through the interior of the sealed vestibule chamber 14 via a substantially unenclosed flow path therein.

The provision of the simple deflector structure 82 within the vestibule chamber 14 adjacent its air intake opening 78 substantially enhances the combustion air cooling of the draft inducer fan motor 58 without the construction expense and fabricational complexity of mechanically interconnecting the air intake opening 78 and the draft inducer fan motor 58 via an enclosed air passageway extending through an air transfer duct structure passing through the vestibule chamber 14 and coupled between and secured to these two furnace elements and/or similarly coupling the fan motor 58 to the heat exchanger 30 using an air transfer duct structure passing through the vestibule chamber and extending between and mechanically coupled to the motor 58 and a burner area of the furnace.

The foregoing detailed description is to be clearly understood as being given by way of illustration and example only, the spirit and scope of the present invention being limited solely by the appended claims.

What is claimed is:

1. A fuel-fired, forced draft heating appliance comprising:

a chamber having an exterior wall with an air intake opening therein;

a heat exchanger;

a fuel burner operative to create hot combustion products in said heat exchanger;

a draft inducer fan disposed in said chamber, having a motor, and being operative to expel flue gas from said heat exchanger and to create with said chamber a negative pressure that draws a first quantity of combustion air into said chamber, for delivery to said fuel burner, sequentially through said air intake opening, through the interior of said chamber via a substantially unenclosed flow path therein, and against said motor in a manner cooling said motor prior to delivery of said first quantity of combustion air to said fuel burner; and a deflector structure supported within said chamber in an inwardly spaced apart, facing relationship with said air intake opening, said deflector structure being operative to be impinged by said first quantity of combustion air and redirect it generally toward said motor through said substantially unenclosed flow path within said chamber.

2. The heating appliance of claim 1 wherein:

said draft inducer fan is further operative to draw a second quantity of combustion air inwardly through said air intake opening for delivery to said fuel burner through the interior of said chamber via a substantially unenclosed flow path therein which bypasses said motor.

3. The heating appliance of claim 2 wherein:

said deflector structure is further operative to be impinged by and change the flow direction of said second quantity of combustion air.

4. The heating appliance of claim 1 wherein:

said deflector structure is a generally flat deflector plate member.

5. The heating appliance of claim 4 wherein:

said deflector plate member is operatively supported and positioned within said chamber by a support member secured to said exterior wall of said chamber.

6. The heating appliance of claim 5 wherein:

said support member is a generally flat member which is angled with respect to said deflector plate member.

7. The heating appliance of claim 6 wherein:

said support plate member is formed integrally with said deflector plate member.

8. The heating appliance of claim 1 wherein:

said heating appliance is an air heating furnace.

9. The heating appliance of claim 8 wherein:

said air heating furnace is a gas-fired air heating furnace.

10. The heating appliance of claim 1 wherein:

said fuel burner is an inshot-type fuel burner.

11. The heating appliance of claim 1 wherein:

said draft inducer fan includes a fan housing, said motor has an apertured housing portion, is disposed externally of said fan housing, and rotationally drives a shaft, and said draft inducer fan further includes a fan blade structure drivably mounted on said shaft externally of said fan housing and being operative to draw combustion air through the interior of said motor housing.

12. The heating appliance of claim 1 further comprising:

a baffle structure positioned adjacent said fuel burner and being operative to shield said fuel burner from flicker-creating impingement by combustion air delivered to said fuel burner through said chamber.

13. The heating appliance of claim 12 wherein:

said fuel burner is carried by a frame, and said baffle structure includes a baffle plate member mounted on said frame.

14. The heating appliance of claim 13 wherein:

said fuel burner is positioned beneath said draft inducer fan within said chamber, and said baffle plate member is mounted on a top side portion of said frame above said fuel burner.

15. The heating appliance of claim 1 wherein:

said motor has a motor housing portion with a plurality of cooling openings therein, and a portion of said first quantity of combustion flows through the interior of said motor housing portion, via said cooling openings therein, during operation of said draft inducer fan.

16. A method of operating a fuel-fired, forced draft heating appliance including a chamber having an exterior wall with an air intake openings therein, a heat exchanger, a fuel burner operatively associated with said heat exchanger, and a draft inducer fan disposed in said chamber, having a motor, and being operative to expel flue gas from said heat exchanger, said method comprising the steps of:

supporting a deflector structure within said chamber in an inwardly spaced apart, facing relationship with said air intake opening; and cooling said motor by sequentially flowing combustion air inwardly through said air intake opening, causing the combustion air entering said chamber through said air intake opening to impinge upon and be deflected in a changed flow direction by said deflector structure, flowing the deflected combustion air into contact with said motor via a substantially unenclosed flow path within said chamber, and then delivering said combustion air to said fuel burner.

17. The method of claim 16 wherein:

said cooling step is performed by utilizing said draft inducer fan to create a negative pressure within said chamber.

18. The method of claim 16 wherein said motor has a housing portion with cooling openings therein and is drivingly coupled to a shaft, and said cooling step includes the steps of:

connecting a fan blade structure to said shaft for driven rotation thereby, and using the rotationally driven fan blade structure to flow combustion air through the interior of said housing portion via said cooling openings therein.

19. The method of claim 16 wherein:

said fuel burner, during operation thereof, generates a flame exposed to said chamber, and said method further comprises the step of shielding said flame from flicker-creating impingement thereon by combustion air delivered to said fuel burner.

20. The method of claim 19 wherein:

said shielding step includes the step of interposing a baffle member between said fuel burner and said draft inducer fan.

21. The method of claim 16 wherein said combustion air is a first quantity of combustion air, and said cooling step further includes the step of:

flowing a second quantity of combustion air inwardly through said intake opening to said fuel burner via a substantially unenclosed flow path disposed within said chamber and bypassing said motor.

22. The method of claim 21 further comprising the step of:

causing said second quantity of combustion air to impinge on said deflector structure.

* * * * *